US006517321B1

(12) United States Patent
Takenaka et al.

(10) Patent No.: US 6,517,321 B1
(45) Date of Patent: Feb. 11, 2003

(54) VARIABLE DISPLACEMENT COMPRESSOR

(75) Inventors: Kenji Takenaka, Kariya (JP); Tetsuhiko Fukanuma, Kariya (JP); Masahiro Kawaguchi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/533,837

(22) Filed: Mar. 23, 2000

(30) Foreign Application Priority Data

Mar. 26, 1999 (JP) ..... 11-083835

(51) Int. Cl.[7] ..... F04B 1/26
(52) U.S. Cl. ..... 417/222.1; 417/222.2
(58) Field of Search ..... 417/222.1, 222.2

(56) References Cited

U.S. PATENT DOCUMENTS 5,173,032 A 12/1992 Taguchi et al. ..... 417/222.2
5,316,446 A * 5/1994 Kimura et al. ..... 417/269
5,573,379 A 11/1996 Kimura et al. ..... 417/222.2
5,577,894 A 11/1996 Kawaguchi et al. ..... 417/222.2
5,836,748 A 11/1998 Kawaguchi et al. ..... 417/222.2
6,203,284 B1 * 3/2001 Kawaguchi et al. ..... 417/222.2

FOREIGN PATENT DOCUMENTS

EP 0 844 392 A3 6/1999 ..... F04B/27/18
JP 07-279844 10/1995

OTHER PUBLICATIONS

European Patent Office Communication, Application No. 00106415.3, Date Jan. 22, 2001, p. 1.

* cited by examiner

*Primary Examiner*—Charles G. Freay
(74) *Attorney, Agent, or Firm*—Morgan & Finnegan, LLP

(57) ABSTRACT

A variable displacement compressor has a crank chamber defined in a housing. A drive shaft is arranged in the housing. A piston is accommodated in the cylinder bore. A swash plate is connected to the piston to convert a rotation of the drive shaft. A retainer surface is arranged in the housing and extends substantially perpendicular to the axis of the drive shaft. A restricting mechanism is arranged between the swash plate and the retainer surface. The restricting mechanism receives the swash plate and restricts movement of the swash plate when the inclination of the swash plate decreases.

26 Claims, 5 Drawing Sheets

VARIABLE DISPLACEMENT COMPRESSOR

BACKGROUND OF THE INVENTION

The present invention relates to variable displacement compressors which can vary displacement by changing the crank chamber pressure.

FIG. 5 shows a swash plate type variable displacement compressor used in automobile air conditioners. A crank chamber 82 is formed between a front housing 80 and a cylinder block 81. A drive shaft 83,that is driven by the automobile engine is supported by the front housing 80 and the cylinder block 81. A lug plate 84 that rotates integrally with the drive shaft 83 is arranged inside the crank chamber 82. A swash plate 85 is connected to the lug plate 84 through a hinge mechanism 102.

A plurality of cylinder bores 86 are formed in the cylinder block 81. Each cylinder bore 86 is arranged at equal intervals about the axis of the drive shaft 83. Pistons 87 are housed inside the cylinder bores 86. When the drive shaft 83 is driven, the swash plate 85 rotates and each piston 87 connected to the swash plate 85 reciprocates inside the associated cylinder bore 86 between a top dead center position and a bottom dead center position. The swash plate 85 converts the rotation of the drive shaft 83 to a reciprocating motion of the piston 87. The displacement is varied by the stroke of the piston 87, which changes in response to the inclination angle of the swash plate 85.

A valve plate 88 is located between the cylinder block 81 and a rear housing 89. A suction chamber 90 and a discharge chamber 91 are located in the rear housing 89. The reciprocating motion of each piston 87 causes refrigerant gas to be drawn into the cylinder bore 86 from the suction chamber 90 and discharges the refrigerant gas, which is compressed in the cylinder bore, into the discharge chamber 91.

The inclination angle of the swash plate 85 and the stroke of the pistons 87 are determined by the pressure (crank pressure) inside the crank chamber 82 and the pressure inside the cylinder bore 86. The displacement of the compressor is varied by changing the inclination angle of the swash plate 85 or, in other words, the stroke of the pistons 87.

The pressure in the crank chamber 82 is varied in response to the difference between the flow rate of refrigerant gas flowing into the crank chamber 82 from the discharge chamber 91 and the flow rate of refrigerant gas flowing out from the crank chamber 82 to the suction chamber 90. A pressurizing passage 92 connects the discharge chamber 91 and the crank chamber 82 by way of an electromagnetic control valve 93. The electromagnetic control valve 93 controls the amount of refrigerant gas flowing into the crank chamber 82 through the pressurizing passage 92. A bleed passage 94 connects the crank chamber 82 and the suction chamber 90. Refrigerant gas inside the crank chamber 82 constantly flows into the suction chamber 90 through the bleed passage 94.

The control valve 93 opens fully when de-excited. This maximizes the flow rate of refrigerant gas entering the crank chamber 82 through the pressurizing passage 92. When the control valve 93 is excited, the control valve 93 closes in accordance with the level of an electrical current supplied to the control valve 93. This restricts the flow rate of refrigerant gas flowing from the discharge chamber 91 to the crank chamber 82.

A lip seal 95 is used to seal the space between the drive shaft 83 and the inner wall surface of the front housing 80.

The end of the drive shaft 83 extends to the outside of the housing. An electromagnetic clutch 96 is fixed to the end of the drive shaft 83. The electromagnetic clutch selectively transfers the drive power of the engine E to the drive shaft 83.

A thrust bearing 97 is located between the lug plate 84 and the front housing 80. The end of the drive shaft 83 is supported in a bore 98. A support spring 100, which is a compression spring, is located between a retaining ring 99 that is located inside the bore 98 and the end of the drive shaft 83. The support spring 100 applies axial force to the drive shaft 83 in a direction towards the front housing 80 (to the left in FIG. 1). Further, the support spring 100 eliminates slack in the axial direct-ion of the drive shaft 83.

The swash plate 85 is at its maximum inclination angle position when it makes contact with the lug plate 84 and is at its minimum inclination angle position when it contacts a stopper ring 101 that is fixed to the drive shaft 83.

When the engine E is stopped, the control valve 93 fully opens and the refrigerant gas flows inside the crank chamber 82 through the pressurizing passage,92. There is a chance that the crank pressure at this time may temporarily increase to an excessively high value. If this occurs, the swash plate 85 (indicated by the broken lines in FIG. 5) presses against the stopper ring 101 with excessive force when it reaches the minimum inclination position. Further, the swash plate 85 pulls the lug plate 84 rearward (to the right in FIG. 1) through a hinge mechanism 102. As a result, the drive shaft 83 will move axially rearward against the support spring 100.

When the automobile accelerates, the displacement of the compressor is reduced to reduce the load of the compressor on the engine E. To accomplish this, the control valve 93 is fully opened and refrigerant gas in the discharge chamber 91 suddenly flows to the crank chamber 82. Therefore, the crank pressure may temporarily increase to an excessively high level, which applies a rearward force to the drive shaft 83.

If the crank pressure increases excessively in this manner, the drive shaft 83 will move rearward in the axial direction. This causes the pistons 87 to move to a position that is closer to the valve plate 88. Consequently, there is a possibility that the head of each piston 87 may strike the valve plate 88 when reaching the top dead center position. This will produce striking noises or vibrations and will damage the pistons 87 and the valve plate 88.

If the drive shaft 83 moves rearward, a movable clutch plate 96*a* of the electromagnetic clutch 96 will also move rearward. Because of this, the movable clutch plate 96*a* and a fixed clutch plate 96*c* make contact even if a magnetic coil 96*b* is demagnetized. As a result, friction occurs between the clutch plates 96*a,* 96*c* leading to noise and heat generation.

Moreover, if the drive shaft 83 moves rearward, the axial position of the drive shaft 83 changes relative to the lip seal 95, which is supported on the front housing 80. Normally, the drive shaft 83 makes contact with the lip seal 95 at a predetermined axial position,. Foreign matter, such as sludge, is adhered to the outer surface of the drive shaft 83 at locations other than the predetermined axial position. Thus, if the axial position of the drive shaft 83 changes relative to the lip seal 95, sludge gets caught between the lip seal 95 and the drive shaft 83. This reduces the sealing performance of the lip seal 95 and causes gas leaks from the crank chamber 82.

In order to solve this problem, increasing the compressive force of the support spring 100 such that the drive shaft 83 does not move rearward even if the crank pressure increases to an excessively high value has been considered. However, this increases the load applied to the thrust bearing 97. Consequently, friction between the thrust bearing 97 and the front housing 80 increases, which shortens the life of the compressor, increases power loss, and decreases the compression efficiency.

SUMMARY OF THE INVENTION

The object of the present invention is to provide a variable displacement compressor that restricts axial movement of the drive shaft and enables each compressor member to function properly.

To achieve the above object, the present invention provides a compressor including a housing, a crank chamber defined in the housing, a drive shaft arranged in the housing and supported by the crank chamber, a cylinder bore extending through the housing, and a piston accommodated in the cylinder bore. A drive plate is connected to the piston to convert a rotation of the drive shaft to a reciprocating motion of the piston. The drive plate inclines relative to the axis of the drive shaft between a maximum inclination position and a minimum inclination position in accordance with the pressure of the crank chamber. A retainer surface is arranged in the housing and extends substantially perpendicular to the axis of the drive shaft. A restricting mechanism is arranged between the drive plate and the retainer surface. The restricting mechanism receives the drive plate and restricts movement of the drive plate when the inclination of the drive plate decreases.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A swash plate type variable displacement compressor according to a first embodiment of the present invention will be described with reference to FIG. 1 to FIG. 3. The compressor employs single-headed pistons and is used in automobile air conditioners.

Figure 1:
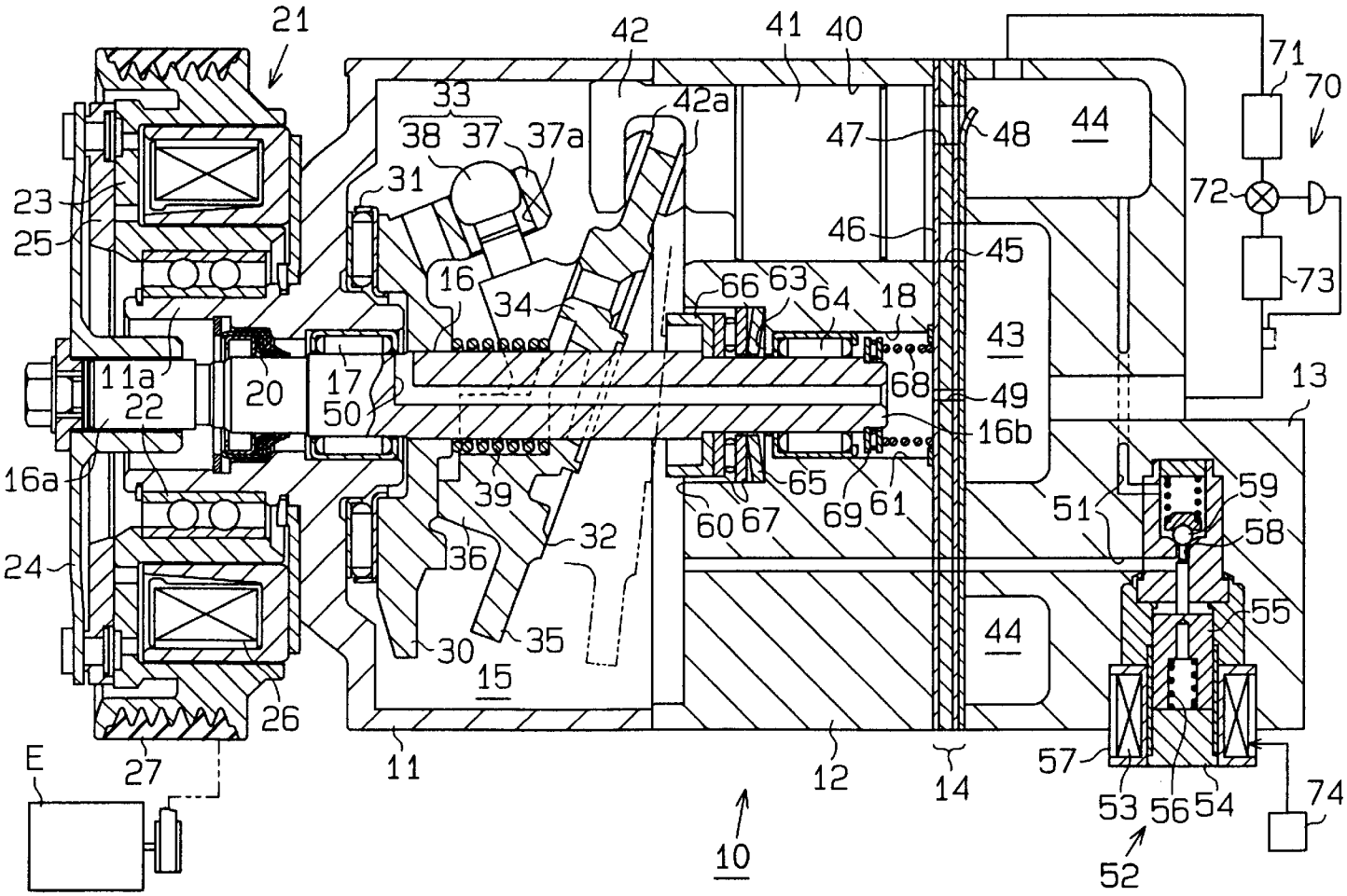
FIG. 1 is a cross-sectional view showing a variable displacement compressor according to a first embodiment of the present invention.

As shown in FIG. 1, the housing of a compressor 10 includes a front housing 11, a cylinder block 12, a rear housing 13 and a valve plate 14. The cylinder block 12 is fixed to the front housing 11. A crank chamber 15 is formed between the front housing 11 and the cylinder block 12. The valve plate 14 is fixed between the cylinder block 12 and the rear housing 13.

A rotatable drive shaft 16 is supported on the housing 11 and on the cylinder block 12. The drive shaft 16 is driven by an automobile engine E that functions as an external drive source. A first end 16*a* of the drive shaft 16 extends from the housing. A central bore (hole) 18 is formed in the cylinder block 12. A second end 16*b* of the drive shaft 16 is positioned inside the central bore 18. A radial bearing 17 is located between the drive shaft 16 and the front housing 11. The radial bearing 31 supports the drive shaft 16.

A boss 11*a* extends from the front end of the front housing 11. A lip seal 20 is arranged between the drive shaft 16 and the boss 11*a* to seal the crank chamber 15. The lip seal 20 is alternately laminated with a plurality of lip rings and backup rings. The drive shaft 16 contacts the lip seal 20 at a predetermined axial position.

An electromagnetic clutch 21 is located between the first end 16*a* of the drive shaft 16 and the engine E. The electromagnetic clutch 21 selectively transfers the drive power of the engine E to the drive shaft 16. Further, the electromagnetic clutch 21 includes a rotor 23 connected to the engine E, a hub 24 fixed to the drive shaft 16 and an armature 25 fixed to the hub 24. The rotor 23, which functions as a clutch plate, is supported by an angular bearing 22 to rotate relative to the boss 11*a*.

The electromagnetic clutch 21 is provided with an electromagnetic coil 26 that is arranged in the rotor 23 and is fixed to the outer wall of the front housing 11. When the electromagnetic coil 26 is excited, the armature 25 is attracted toward the rotor 23 in opposition to the elastic force of the hub 24 and engages the rotor 23. This transmits the drive power of the engine E to the drive shaft 16. When the electromagnetic coil 26 is demagnetized, the armature 25 separates from the rotor 23 and discontinues the transmission of the drive power from the engine E to the drive shaft 16. A belt 27 connects the rotor 23 to the engine E.

Inside the crank chamber 15, a lug plate 30, which functions as a rotation support member, is fixed to the drive shaft 16 to rotate integrally with the drive shaft 16. A thrust bearing 31 is located between the lug plate 30 and the front housing 11. The thrust bearing 31 supports the lug plate 30 in the axial direction so that the lug plate 30 is rotatable with respect to the front housing 11. Further, the thrust bearing 31 restricts axial movement of the drive shaft 16.

The lug plate 30 and the swash plate 32, which function as a drive plate, are connected to each other by a hinge mechanism 33, which functions as a first connection means.

The swash plate 32 has a central portion 34, through which the drive shaft 16 extends, and an annular peripheral portion 35 extending about the central portion 34. Referring to FIG. 1, the swash plate 32 inclines relative to the axis of the drive shaft 16 within an angle range defined between the position indicated by the solid line and the position indicated by the dotted line. Further, the swash plate 32 includes a counterweight 36. that extends from the central portion 34 towards the front.

As shown in FIG. 1, the hinge mechanism 33 includes guide pins 38 extending from the swash plate 32 and a pair of support arms 37 extending from the lug plate 30. A guide hole 37*a* extends through the distal end of each support arm 37. The guide pins 38 are fitted in the corresponding guide holes 37*a*.

A first coil spring 39, which is a compression spring, is arranged on the drive shaft 16 between the lug plate 30 and the swash plate 32. The first coil spring 39 applies a rearward force to the swash plate 32 in the axial direction of the drive shaft 16 to reduce the inclination angle of the swash plate 32.

A plurality of cylinder bores 40 extend through the cylinder block 12 parallel to the drive shaft 16. The cylinder bores 40 are arranged at fixed angular intervals about the axis L of the drive shaft 16. A single-headed piston 41 is housed inside each cylinder bore 40. Each piston 41 is coupled to the swash plate 32 by a pair of shoes 42*a*. The shoes 42*a* convert the rotational motion of the swash plate 32 to reciprocating motion of each piston 41. In this embodiment, the shoes 42*a* and a socket 42, which accommodates the shoes 42*a,* define a second connection means.

A suction chamber 43, which functions as a suction pressure region, and a discharge chamber 44, which functions as a discharge pressure region, are formed inside the rear housing 13. The valve plate 14 has suction ports 45, suction valves 46, discharge ports 47, and discharge valves 48 for each cylinder bore 40. When each piston 41 moves from the top dead center position toward the bottom dead center position, the refrigerant gas in the suction chamber 43 opens the associated suction valve 46 and flows into the associated cylinder bore 40 through the associated suction port 45. When each piston 41 moves from the bottom dead center position toward the top dead center position, the refrigerant gas inside the cylinder bore 40 is compressed to a predetermined pressure. Thereafter, the gas opens the associated discharge valve 48 and is discharged into the discharge chamber 44 through the associated discharge port 47.

A bleed passage 50 is formed inside the drive shaft 16 to connect the crank chamber 15 and the central bore 18. A bleed port 49 is formed in the valve plate 14 to connect the central bore 18 and the suction chamber 43. In this embodiment, the bleed passage 50, the central bore 18 and the bleed port 49 define a gas release passage.

A pressurizing passage 51 is formed in the cylinder block 12 and the rear housing 13 to connect the crank chamber 15 and the discharge chamber 44. An electromagnetic control valve 52, which is located within the pressurizing passage 51, is controlled based on external commands to vary the amount of refrigerant gas flowing from the discharge chamber 44 to the crank chamber 15.

The electromagnetic control valve 52 is an electromagnetic proportion control valve and includes a solenoid formed by a coil 53, a fixed steel core 54, a movable steel core 55, and a return spring 56. The return spring 56 urges the movable steel core 55 upward. When the coil 53 is excited, the movable steel core 55 moves toward the fixed steel core 54, in proportion to the level of an electrical current being supplied, against the force of the return spring 56. A valve opening 58 is located in the pressurizing passage 51. The opening size of the valve opening 58 is varied by a movable valve body 59 in accordance with the movement of the movable steel core 55.

Next, the central bore 18, which is a novel feature, will be described.

As shown in FIG. 1, the central bore 18 includes a large diameter portion 60 and a small diameter portion 61, both of which extend in the axial direction of the drive shaft 16. The central bore 18 extends from the crank chamber 15 to the rear housing 13.

Figure 2:
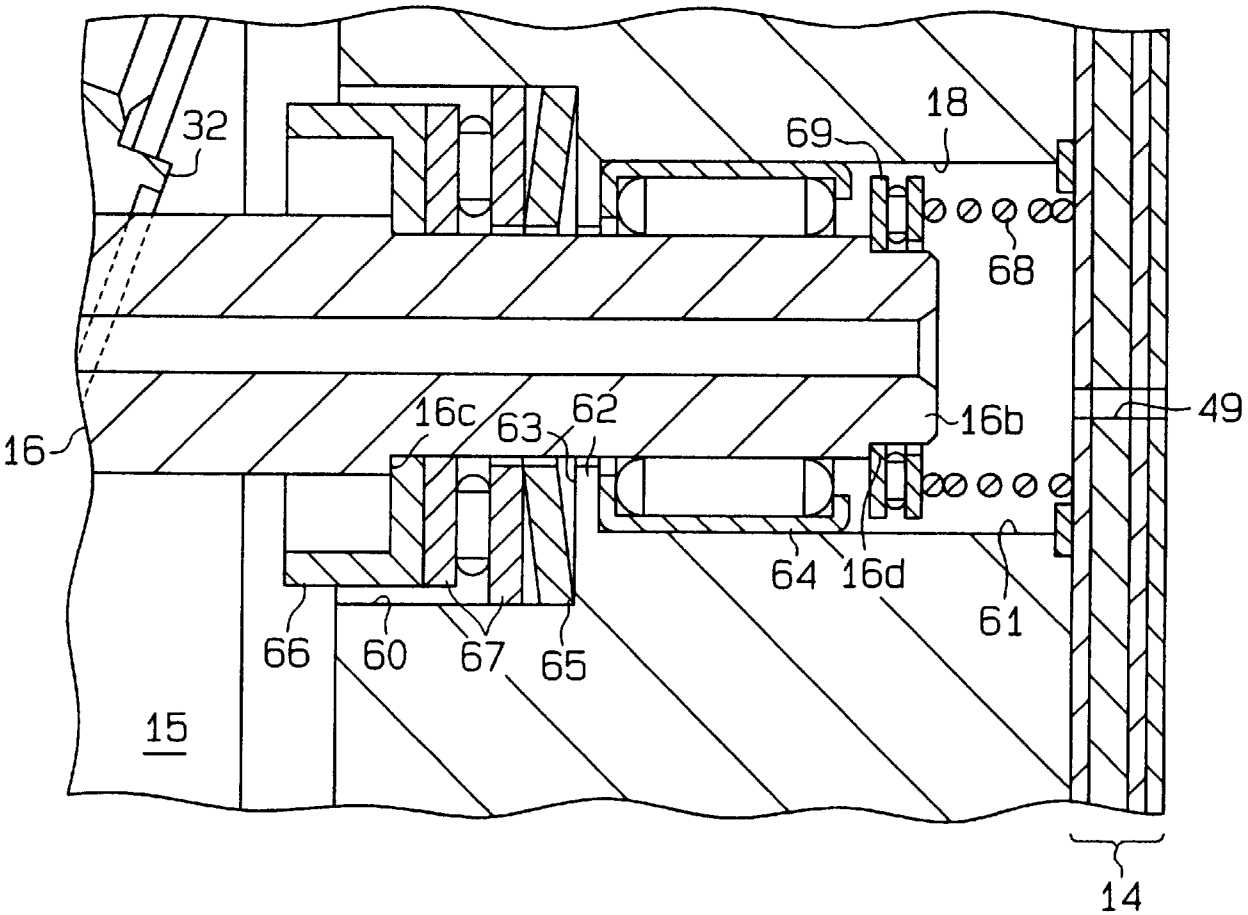
FIG. 2 is a partial cross-sectional view showing the cylinder block of the compressor of FIG. 1.
Figure 3:
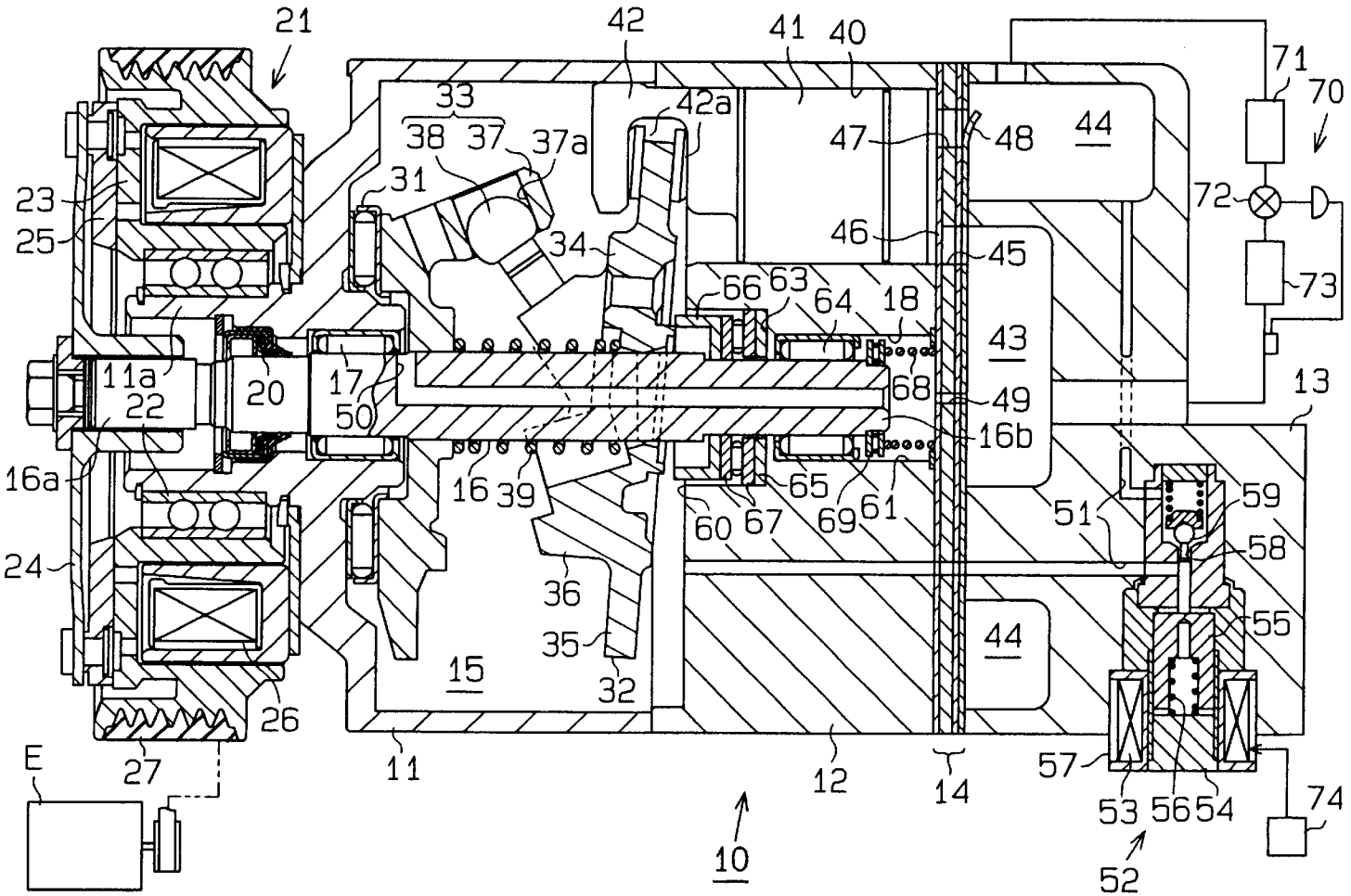
FIG. 3 is a cross-sectional view showing the swash plate of the compressor of FIG. 1 at its minimum inclination angle position.

As shown in FIG. 2, the large diameter portion 60 is located near the crank chamber 15. The second end 16*b* of the drive shaft 16 has a stepped portion 16*c* arranged in the large diameter portion 60. The small diameter portion 61 is located between the large diameter portion 60 and the valve plate 14. The second end 16*b* of the drive shaft 16 is arranged inside the small diameter portion 61. An annular retainer 62 extends radially from the end of the large diameter portion 60. The retainer 62 includes an annular retainer surface 63 that extends in the radial direction of the drive shaft 16.

A radial bearing 64, which functIons as a support member, is fixed between the drive shaft 16 and the wall of the small diameter portion 61. The drive shaft 16 is rotatable relative to the small diameter portion 61 through the radial bearing 64.

In the small diameter portion 61, a second coil spring 68, which is a compression spring, is located between a thrust bearing 69 and the valve plate 14. The second end 16*b* of the drive shaft 16 has a stepped portion 16*d*. The thrust bearing 69 is engaged with the stepped portion 16*d* and is fitted to the drive shaft 16. The second coil spring 68 urges the drive shaft 16 in the frontward direction through the thrust bearing 69.

A stopper 66, that makes contact with the central portion 34 of the swash plate 32 when the swash plate 32 is at the minimum inclination angle position, is arranged between the stepped portion 16*c* of the drive shaft 16 and a thrust bearing 67. The annular stopper 66 is fitted to the drive shaft 16. The inner portion of the stopper 66 is engaged with the stepped portion 16*c*. Further, the stopper 66 is formed such that it extends from the central bore 18 to the inside of the crank chamber 15. That is, the stopper 66 extends from the front surface of the cylinder block 12 into the crank chamber 15 even when the stopper 66 is engaged with the stepped portion 16*c*.

A conical disc spring 65, which functions as an elastic member, is fitted to the drive shaft 16 between the retainer surface 63 and the thrust bearing 67. The conical disc spring 65 urges the thrust bearing 67 and the stopper 66 in the frontward direction. Further, the conical disc spring 65 contacts the retainer surface 63 and restricts axial movement of the drive shaft 16.

The stopper 66, the thrust bearing 67, and the conical disc spring 65 restrict inclination of the swash plate 32 toward the cylinder block 12. In this embodiment, the conical disc spring 65, the stopper 66, and the thrust bearing 67 function as a restricting mechanism.

When the crank pressure increases causing the swash plate 32 to contact the stopper 66, the conical disc spring 65 allows the swash plate 32 to move rearward only by a predetermined distance. This absorbs dimensional margins of the drive shaft 16 and the front housing 11 resulting from thermal expansion and tolerances allowed during manufacture. Furthermore, the movement of the swash plate 32 allowed by the conical disc spring 65 is such that it does not interfere with the engagement operations of the electromagnetic clutch 21, the sealing of the lip seal 20, and the reciprocating motion of the pistons 41.

As shown in FIG. 1, the suction chamber 43 and the discharge chamber 44 are connected through an external refrigerant circuit 70. The external refrigerant circuit 70 includes a condenser 71, an expansion valve 72, and an evaporator 73.

A controller 74 controls the electrical current supplied to the control valve 52 such that the opening size of the electromagnetic control valve 52 varies continuously based on external information from various sensors and selector switches (not shown).

Next, the function of the above compressor will be described.

Forward movement of the drive shaft 16 in the axial direction is restricted when the lug plate 30 contacts the front housing 11 through the thrust bearing 31. Further, rearward movement of the drive shaft 16 in the axial direction is restricted by the second coil spring 68.

When the engine E is running and the external refrigerant circuit 70 starts the cooling operation, the controller 74 connects the engine E to the drive shaft 16 with the electromagnetic clutch 21. This rotates the drive shaft 16, which in turn, rotates the swash plate 32 integrally with the lug plate 30. Accordingly, each piston 41 reciprocates at a stroke determined by the inclination angle of the swash plate 32. As a result, refrigerant gas is supplied to the external refrigerant circuit 70.

When the controller 74 reduces the opening size of the control valve 52, the flow rate of refrigerant gas flowing into the crank chamber 15 decreases, which causes the crank pressure to fall. This increases the inclination angle of the swash plate 32 and the stroke of the pistons 41. As a result, the displacement of the compressor 10 increases.

In contrast, when the controller 74 increases the opening size of the control valve 52, the flow rate of refrigerant gas entering the crank chamber 15 increases and causes the crank pressure to increase. This decreases the inclination angle of the swash plate 32 and the stroke of the pistons 41. As a result, the displacement of the compressor 10 decreases.

As the crank pressure increases and causes the swash plate 32 to approach the stopper 66, the pressure in the cylinder bores 40 and the urging force of the second coil spring 68 restricts rearward axial movement of the drive shaft 16. When the crank pressure causes the swash plate 32 to contact the stopper 66, the swash plate 32 is at the minimum inclination angle position.

If the cooling operation or the engine E is stopped when the displacement of the compressor 10 is large and the crank pressure is low, the supply of electrical current to the electromagnetic control valve 52 is stopped. This maximizes the opening size of the control valve 52. As a result, the flow rate of refrigerant gas from the discharge chamber 44 to the crank chamber 15 increases suddenly.

Since the flow rate of refrigerant gas flowing from the crank chamber 15 to the suction chamber 43 through the bleed passage 50 is relatively low, the crank pressure increases suddenly. As a result, the crank pressure exceeds the value at which the swash plate 32 contacts the stopper 66, which moves the swash plate 32 to the minimum inclination angle in a sudden manner. In this case, the swash plate 32 moves further rearward in the axial direction of the drive shaft 16 against the force of the conical disc spring 65 and compresses the conical disc spring 65. As shown in FIG. 3, when the conical disc spring 65 is fully compressed, the inclination angle of the swash plate 32 relative to a plane perpendicular to the axis of the drive shaft 16 is substantially null. Furthermore, the retainer surface 63 restricts further movement of the swash plate 32 by way of the stopper 66, the thrust bearing 67, and the conical disc spring 65. Consequently, the force produced by the crank pressure is not applied directly to the drive shaft 16 from the swash plate 32.

The advantages of this embodiment will now be described.

Movement of the swash plate 32 in the axial direction of the drive shaft 16 is restricted even if the crank pressure becomes higher than a value that moves the swash plate 32 to the minimum inclination angle position. Further, dimensional margins of the drive shaft 16 and the front housing 11 resulting from thermal expansion and tolerances allowed during manufacture are absorbed by the conical disc spring 65. Thus, the drive shaft 16 is held firmly and has no slack in the axial direction.

Accordingly, problems that would occur due to movement of the swash plate 32 in the axial direction of the drive shaft 16 are avoided. More specifically, impact between the pistons 41 and the valve plate 14 is prevented. Further, the lip seal 20 is not separated from the predetermined position relative to the drive shaft 16 and abnormal wear of the lip seal 20, caused by sludge adhering to the drive shaft 16, does not occur.

The swash plate 32 does not contact the stopper 66 until reaching the minimum inclination angle position. Therefore, the swash plate 32 moves quickly until contacting the stopper 66. Thus, the displacement is quickly reduced.

Figure 5:
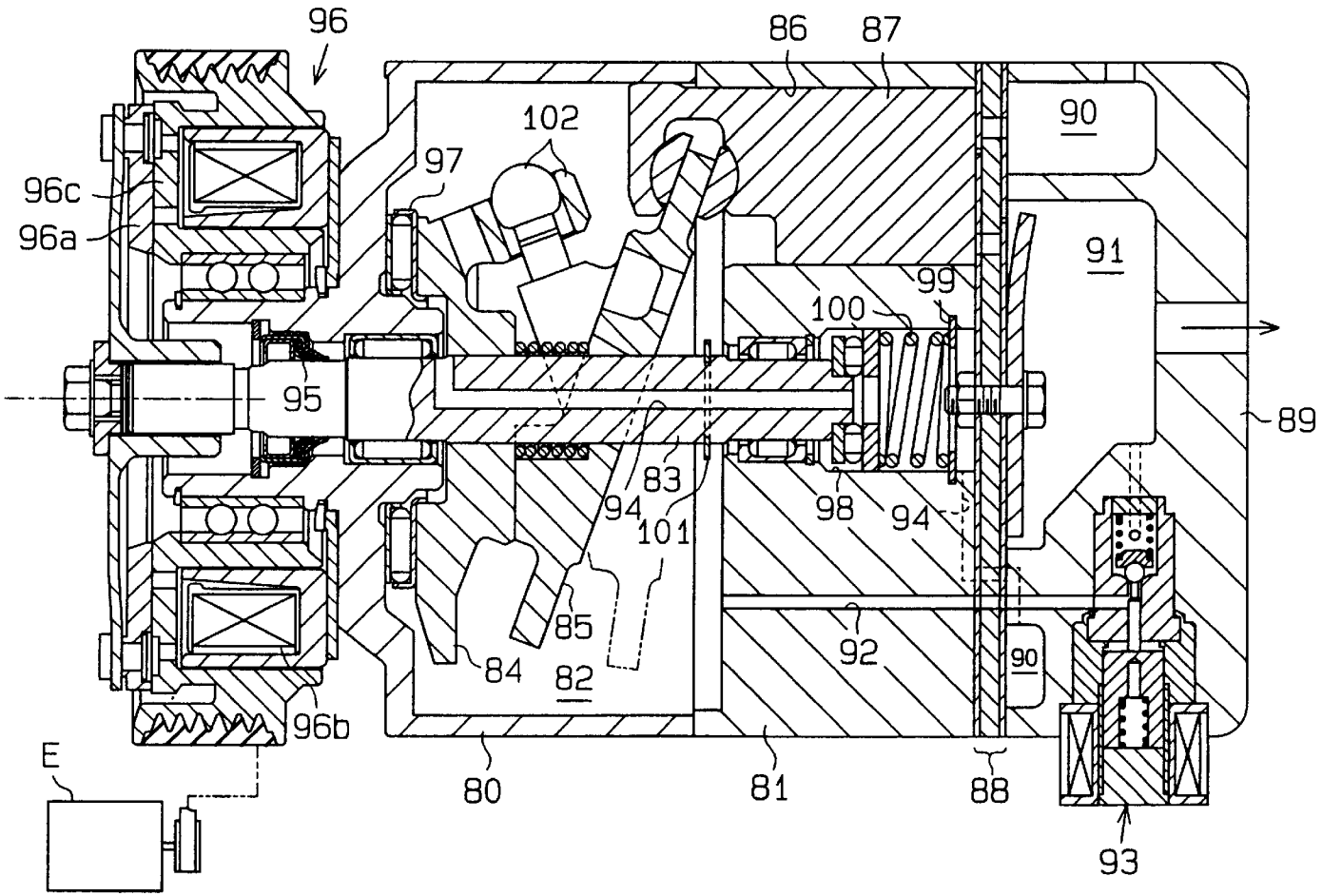
Fig.5 (Prior Art)
FIG. 5 is a cross-sectional view: showing a prior art variable displacement compressor.

The second coil spring 68 is located between the thrust bearing 69 and the valve plate 14. Therefore, the retaining ring 99 employed in the conventional compressor of FIG. 5 is not required. Thus, the structure of the central bore 18 is simplified.

The conical disc spring 65 absorbs axial, dimensional margins of the drive shaft 16 and the front housing 11 and firmly supports the drive shaft 16 in the axial direction.

The conical disc spring 65, the thrust bearing 67, and the stopper 66, which function as the movement restricting mechanism, are located inside the large diameter portion 60 of the central bore 18. Therefore, the movement restricting mechanism does not interfere with the cylinder bores 40. This avoids an increase in the size of the compressor 10.

The compressor 10, to which the present invention is applied, controls the crank pressure with the electromagnetic control valve 52, which is controlled externally. Hence, for example, the crank pressure is changed from a low value to a high value more abruptly than a compressor employing an internal control valve that changes the crank pressure with a pressure-sensitive member, such as a bellows, based on the suction pressure of the refrigerant gas returning from the external refrigerant circuit 70. Therefore, the displacement is varied in a sudden manner, while preventing movement of the drive shaft 16 in the axial direction.

The flow rate of refrigerant gas through the pressurizing passage 51 into the crank chamber 15 is maximized when no current is supplied to the control valve 52. Therefore, the crank pressure is maximized when the supply of current to the control valve 52 is stopped. As a result, the compressor 10 does not apply a large load to the engine E when restarting the cooling operation or the engine E.

The present invention prevents undesirable contact between the rotor 23 and the armature 25 that might otherwise be caused by rearward axial movement of the drive shaft 16. This prevents abnormal noises and abnormal wear resulting from contact between the rotor 23 and the armature 25.

It should be apparent to those skilled in the art that the present invention may be embodied in many other specific forms without departing from the spirit or scope of the invention. Particularly, it should be understood that the present invention may be embodied in the following forms.

In the embodiment shown in FIG. 1 to FIG. 4, the minimum inclination angle of the swash plate 32 is stipulated when the swash plate 32 contacts the stopper 66.

However, the minimum inclination angle position is not limited to this location. In other words, the minimum inclination angle position may be where the swash plate 32 is located when the conical disc spring 65 is completely compressed and the drive shaft 16 is moved to the most rearward position by the swash plate 32.

A closed hole may be formed in place of the central bore 18. The retainer, the support member, and the movement restricting mechanism can be located inside the closed hole.

The conical disc spring 65 may be eliminated from the restricting mechanism. That is, the restricting mechanism may be formed by only the stopper 66 and the thrust bearing 67.

Figure 4:
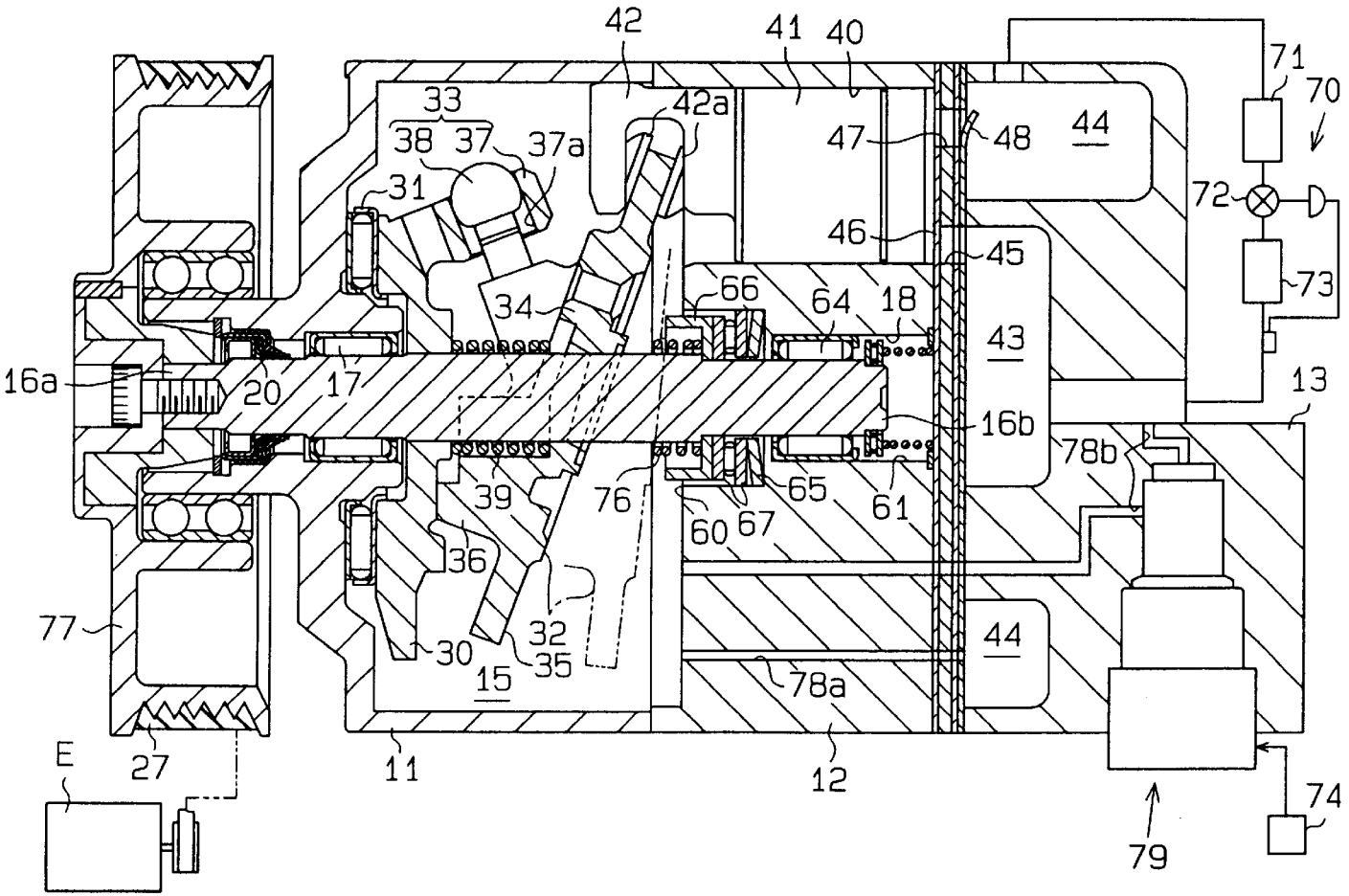
FIG. 4 is a cross-sectional view showing a variable displacement compressor according to a second embodiment of the present invention.

As shown in FIG. 4, a coil spring 76 can be located between the stopper 66 and the swash plate 32. The coil spring 76 functions as a buffer and makes contact with the swash plate 32 before the swash plate 32 reaches the minimum inclination angle position to absorbs the impact of the swash plate 32 against the stopper 66. According to this composition, the force of the coil spring 76 causes the swash plate 32 to gradually come into contact with the stopper 66.

The present invention may be applied to a clutchless compressor, such as that shown in FIG. 4. This compressor is not provided with the electromagnetic clutch 21 shown in FIGS. 1 and 3 and has a pulley 77 fixed to the drive shaft 16.

As shown in FIG. 4, the present invention may be applied to a compressor having an introduction of passage 78*a* connecting the discharge chamber 44 and the crank chamber 15. Refrigerant gas is introduced into the crank chamber from the discharge chamber 44 through the introduction passage 78*a*. A discharge passage 78*b* connects the crank chamber 15 and the suction chamber 43. Refrigerant gas flows to the suction chamber 43 from the crank chamber 15 through the discharge passage 78*b*. An electromagnetic control valve 79 varies the crank pressure by changing the amount of refrigerant gas flowing from the crank chamber 15 to the suction chamber 43 based on external signals. Further, the electromagnetic control valve 79 can also have a pressure-sensitive mechanism that controls the flow rate of refrigerant gas based on the suction pressure of the suction chamber 43.

The electromagnetic control valves 52, 79 do not necessarily have to be valves that continuously vary their opening sizes in accordance with the supplied electrical current. An electromagnetic control valve that switches the opening size between a fully closed state and a fully opened state by permitting or stopping the supply of electrical current can also be used.

The present invention can also employ an electromagnetic control valve that is integral with the housing.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A compressor comprising:

a housing, wherein the housing includes a cylinder block;

a crank chamber defined in the housing;

a drive shaft supported in the crank chamber;

a cylinder bore in the housing;

a piston accommodated in the cylinder bore;

a bias spring engaging the drive shaft to restrict the drive shaft's rearward axial movement;

a drive plate driven by The drive shaft and connected to the piston to convert a rotation of the drive shaft to a reciprocating motion of the piston, wherein the drive plate inclines relative to the axis of the drive shaft between maximum inclination position and a minimum inclination position in accordance with the pressure of the crank chamber;

a retainer surface formed in the cylinder block, wherein the retainer surface is located around the drive shaft; and a restricting mechanism reactive with the retainer surface, such that the restricting mechanism contacts the drive plate and units the maximum amount of movement of the drive plate in the direction of the drive shaft axis as the drive plate approaches the minimum inclination position.

2. The compressor according to claim 1, wherein the housing includes a hole for accommodating the restricting mechanism, wherein part of a wall defining the hole forms the retainer surface.

3. The compressor according to claim 2, wherein the drive shaft extends through the hole, and wherein the restricting mechanism surrounds the drive shaft.

4. The compressor according to claim 2, wherein the housing includes a cylinder block, the hole and the cylinder bore are formed in the cylinder block, the cylinder block includes a flat surface defining part of the crank chamber, and the hole is formed in the flat surface.

5. The compressor according to claim 1, wherein the restricting mechanism includes a stopper for engaging the drive plate when the drive plate moves to the minimum inclination position.

6. The compressor according to claim 1, wherein the restricting mechanism includes:

a stopper for engaging the drive plate when the drive plate moves to the minimum inclination position a support member for permitting relative rotation between the stopper and the retainer surface.

7. The compressor according to claim 6, wherein the restricting mechanism further includes an elastic body arranged between the retainer surface and the support member, wherein the elastic body permits movement of the drive plate for a predetermined distance after the drive plate contacts the stopper when the inclination of the drive plate decreases.

8. The compressor according to claim 7, wherein the elastic body is a conical disc spring.

9. The compressor according to claim 7, wherein the drive shaft has a stepped portion, wherein the stopper is annular and fitted to the drive shaft, and wherein the stopper engages the stepped portion to prevent the stopper from moving toward the drive plate.

10. The compressor according to claim 9, wherein the stopper extends into the crank chamber when the stopper engages the stepped portion.

11. The compressor according to claim 9, further comprising:

a discharge chamber defined in the housing;

a suction chamber defined in the housing;

a pressurizing passage for supplying gas to the crank chamber from the discharge chamber;

a bleed passage for releasing gas from the crank chamber to the suction chamber; and an electromagnetic control valve for changing the rate of gas flowing into the crank chamber through the pressurizing passage.

12. The compressor according to claim 11, wherein the electromagnetic control valve maximizes the amount of gas flowing through the pressurizing passage when the electromagnetic valve is deactivated.

13. The compressor according to claim 1, further comprising a clutch mechanism including two clutch plates, wherein the external power is transmitted to the drive shaft when engaging the clutch plates and not transmitted when disengaging the clutch plates.

14. The compressor according to claim 3, wherein a buffer member is arranged between the stopper and the drive plate.

15. The compressor according to claim 1, wherein the housing has a shaft-receiving bore and one end of the drive shaft is supported in the bore by a radial supporting member, wherein the radial supporting member is located between the end of the drive shaft and the retainer surface.

16. A compressor comprising:

a housing;

a crank chamber defined in the housing;

a drive shaft supported in the housing;

a cylinder bore in the housing;

a piston accommodated in the cylinder bore;

a bias spring engaging the drive shaft to restrict the drive shaft's rearward axial movement;

a drive plate connected to the piston to convert a rotation of the drive shaft to a reciprocating notion of the piston, wherein the drive plate inclines relative to the axis of the drive shaft between a maximum inclination position and a minimum inclination position in accordance with the pressure of the chamber;

a retainer surface associated with the housing;

a restricting mechanism reactive with the retainer surface, wherein the restricting mechanism includes a stopper and an elastic body, wherein the stopper engages the drive plate when the drive plate moves to The minimum inclination position, wherein the elastic body is arranged between the retainer surface and the stopper, and wherein the elastic body permits movement of the drive plate in the direction of the drive shaft axis for a predetermined distance after the drive plate contacts the stopper as the drive plate approaches the minimum inclination position.

17. The compressor according to claim 16, wherein the restricting mechanism further includes a thrust bearing located between the stopper and the elastic body to permit relative rotation between the stopper and the elastic body.

18. The compressor according to claim 16, wherein the elastic body is a conical disc spring.

19. The compressor according to claim 16, wherein the housing includes a hole for accommodating the restricting mechanism, wherein part of a wall defining the hole forms the retainer surface.

20. The compressor according to claim 19, wherein the drive shaft extends through the hole, and wherein the restricting mechanism surrounds the drive shaft.

21. The compressor according to claim 19, wherein the housing includes a cylinder block, the hole and the cylinder bore are formed in the cylinder block, the cylinder block includes a flat surface defining part of the crank chamber, and the hole is formed in the flat surface.

22. A compressor comprising:

a housing, wherein the housing includes a cylinder block;

a crank chamber defined in the housing;

a drive shaft supported in the housing;

a bias spring engaging the drive shaft to restrict the drive shaft's reward axial movement;

a cylinder bore in the housing receiving a piston therein;

a drive plate driven by the drive shaft and reactive with the piston to convert rotation of the drive shaft to a reciprocating motion of the piston, the drive plate having a variable inclination relative to the drive shaft axis between maximum and minimum inclination positions along the drive shaft axis according to the pressure of the crank chamber;

a retainer surface formed in the cylinder block; wherein the retainer surface is located around the drive shaft; and a restricting mechanism supported in the housing, wherein the restricting mechanism reacts with the retainer surface to limit the maximum amount of movement of the drive plate, and wherein the restricting mechanism has a stopper of which at least a portion is located in the crank chamber for contacting the drive plate as the drive plate approaches its minimum inclination position.

23. The compressor according to claim 22 wherein the stopper element is resiliently biased in the direction of the forward end of the drive shaft.

24. The compressor according to claim 22, wherein the restricting member also limits the axial movement of the drive shaft in the direction of its rearward end.

25. A compressor comprising:

a housing;

a crank chamber defined in the housing;

a drive shaft supported in the housing and resiliently biased toward a forward driven end thereof;

a cylinder bore in the housing receiving a piston therein;

a drive plate driven by the drive shaft and reactive with the piston to convert rotation of the drive shaft to a reciprocating motion of the piston, the drive plate having a variable inclination relative to the drive shaft axis between maximum and minimum inclination positions along the drive shaft axis according to the pressure of the crank chamber;

a retainer surface associated with the housing; and a restricting mechanism reactive with the retainer surface, wherein the restricting mechanism contacts the drive plate and restricts movement of the drive plate in the direction of the drive shaft axis as the drive plate approaches the minimum inclination position, wherein the restricting mechanism includes a stopper for engaging the drive plate when the drive plate moves to the minimum inclination position and a support member for permitting relative rotation between the stopper and the retainer surface, wherein the restricting mechanism further includes an elastic body arranged between the retainer surface and the support member, wherein the elastic body permits movement of the drive plate for a predetermined distance after the drive plate contacts the stopper when the inclination of the drive plate decreases, and wherein the elastic body is a conical disc spring.

26. A compressor comprising:

a housing;

a crank chamber defined in the housing;

a drive shaft arranged in the housing and supported by the crank chamber;

a cylinder bore extending through the housing;

a piston accommodated in the cylinder bore;

a drive plate connected to the piston to convert a rotation of the drive shaft to a reciprocating motion of the piston, wherein the drive plate inclines relative to the axis of the drive shaft between a maximum inclination position and a minimum inclination position in accordance with the pressure of the crank chamber;

a retainer surface arranged in the housing;

a restricting mechanism arranged between the drive plate and the retainer surface, wherein the restricting mechanism includes a stopper and an elastic body, wherein the stopper engages the drive plate when the drive plate moves to the minimum inclination position, wherein the elastic body is arranged between the retainer surface and the stopper, wherein the elastic body permits movement of the drive plate for a predetermined distance after the drive plate contacts the stopper when the inclination of the drive plate decreases, wherein the restricting mechanism further includes a thrust bearing located between the stopper and the elastic body to permit relative rotation between the stopper and the elastic body, and wherein the elastic body, and wherein the elastic body is a conical disc spring.

* * * * *

UNITED STATES PATENT AND TRADEMARK OFFICE

CERTIFICATE OF CORRECTION

PATENT NO. : 6,517,321 B1 
DATED : February 11, 2003
INVENTOR(S) : Kenji Takenka et al.

It is certified that error appears in the above-identified patent and that said Letters Patent is hereby corrected as shown below:

Column 10,
Line 3, please delete "The" and insert therefore -- the --
Line 15, please delete "unites" and insert therefore -- limits --

Column 11,
Line 26, please delete "notion" and insert therefore -- motion --

Signed and Sealed this

Twenty-second Day of April, 2003

JAMES E. ROGAN
*Director of the United States Patent and Trademark Office*